United States Patent [19]

Lord

[11] 4,067,381

[45] Jan. 10, 1978

[54] TEMPERATURE COMPENSATED QUANTITY INDICATOR

[75] Inventor: Thomas J. Lord, Dayton, Ohio

[73] Assignee: United Aircraft Products, Inc., Dayton, Ohio

[21] Appl. No.: 710,262

[22] Filed: July 30, 1976

Related U.S. Application Data

[63] Continuation-in-part of Ser. No. 596,103, July 16, 1975, abandoned.

[51] Int. Cl.[2] ..... F01P 11/18; G01F 15/02

[52] U.S. Cl. ..... 165/11; 62/129; 73/40.5 R; 123/41.15; 165/107

[58] Field of Search ..... 165/11, 107; 62/129; 73/40.5 R, 149; 137/558; 123/41.15

[56] References Cited

U.S. PATENT DOCUMENTS

| | | | |
|---|---|---|---|
| 3,410,102 | 11/1968 | Karsten | 62/129 |
| 3,602,294 | 8/1971 | Wanson | 165/11 |

*Primary Examiner*—Albert W. Davis, Jr.
*Attorney, Agent, or Firm*—J. E. Beringer

[57] ABSTRACT

Apparatus indicating the quantity of fluid in a closed and pressurized fluid circulating system. The apparatus compensates or corrects for fluid expansion and contraction due to temperature change so that the indicated quantity is the true quantity. The apparatus includes a direct acting, mechanical connection from a fluid accumulator-reservoir device to an indicator. A thermostat sensing fluid temperature introduces a correction into the mechanical connection.

10 Claims, 4 Drawing Figures

FIG-1
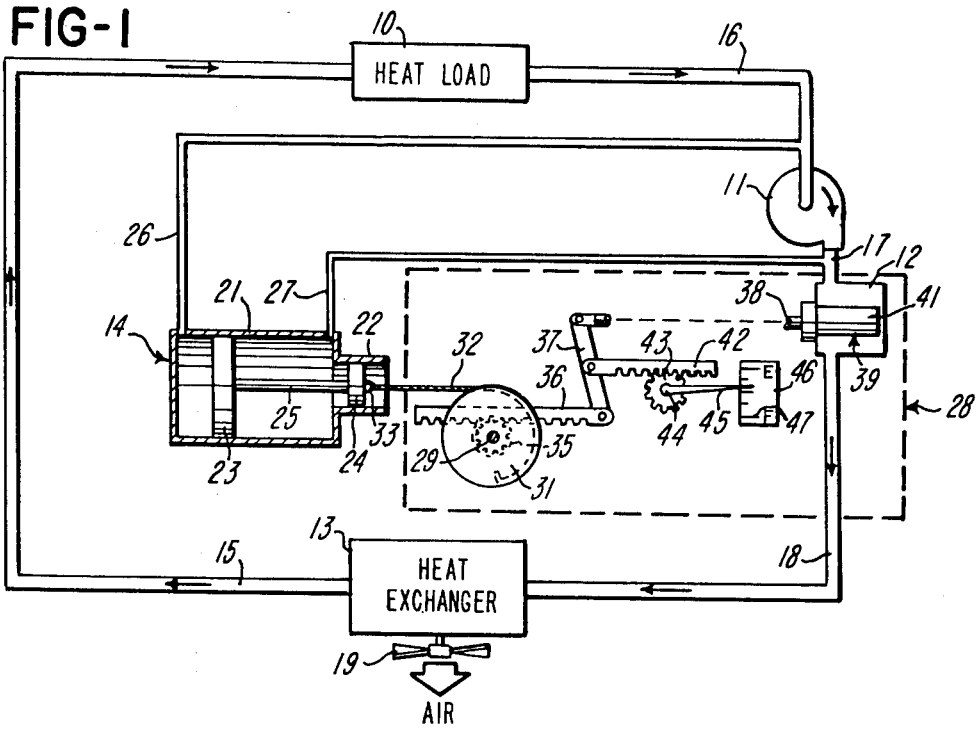
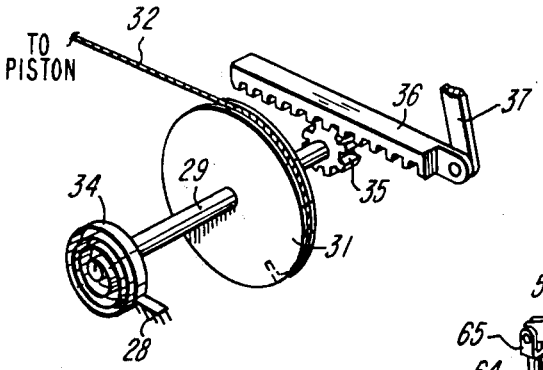
FIG-2
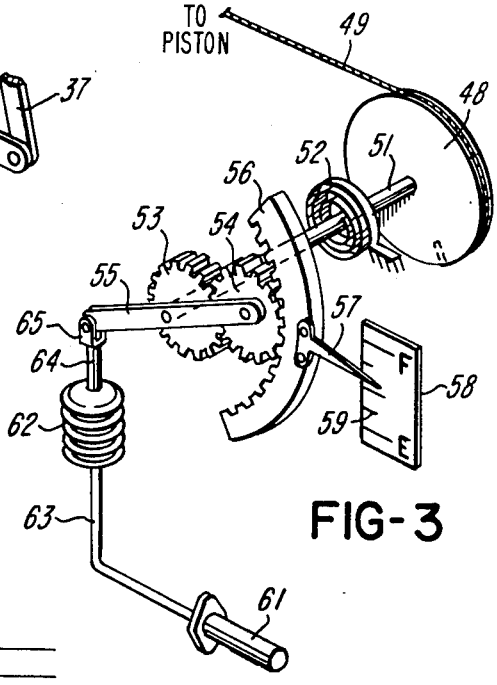
FIG-3
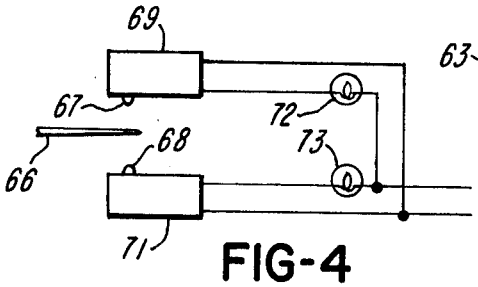
FIG-4

TEMPERATURE COMPENSATED QUANTITY INDICATOR

This is a continuation-in-part of prior application Ser. No. 596,103, filed July 16, 1975.

BACKGROUND OF THE INVENTION

This invention relates to systems circulating and cooling a liquid coolant, or the like, and particularly to apparatus for indicating the quantity of liquid in the system, which apparatus is temperature compensated to obviate false indications due to temperature change. A circulating system of the kind set forth includes an accumulator-reservoir device maintaining pressure in the system and accommodating temperature induced expansion of the coolant.

It is desirable for obvious reasons to indicate the quantity of liquid in a liquid coolant circulating system. Such inidication is complicated, however, by the fact that the density of the coolant increases and reduces in an inverse relation to temperature change. It is not possible, therefore, to make an accurate reading of coolant quantity unless temperature effects are compensated for. The prior art contains examples of temperature compensated indicators. However, in known instances these examples are directly associated with accumulator-reservoir devices in the system, or, in an electrical version, resistance variations in a potentiometer are analyzed by an electronic circuit. The former examples require access to and direct reading of a scale on the accumulator-reservoir device. The latter have a "black box" mysticism involving specialized manufacture and servicing. Also, in some instances, as in aircraft use, generated electrical noise and magnetic effects may be regarded as objectionable.

RELATED PRIOR ART

Hill et al, U.S. Pat. No. 3,559,727, Feb. 2, 1971
Hughes, U.S. Pat. No. 3,651,863, Mar. 28, 1972
Bathla et al, U.S. Pat. No. 3,677,334, July 18, 1972

SUMMARY OF THE INVENTION

The present invention contemplates in plural illustrated embodiments a continuing display of actual quantity in a fluid coolant circulating system, using a scale calibrated in terms of quantity. Motion of a pressure applying piston in an accumulator-reservoir device is used to initiate changes in the indicated reading. A connection from such device to the indicating scale is direct and mechanical in form. Incorporated in the connection is a means which in the presence of sensed temperature change alters the mechanical motion to compensate for or to nullify the effects of piston movement which are due to temperature induced expansion and contraction of the fluid. According to different invention embodiments, the connection from the accumulator-reservoir device to an indicating means includes an oscillatory lever. In one illustrated instance a thermostat shifts the pivot point of a lever in a manner to cancel pressure piston effects, and in the other illustrated instance a thermostat effects a powered rocking motion of a lever, again in a manner to cancel pressure piston effects. A feature of the invention lies in use of temperature compensated indicating means in conjunction with a bootstrap type accumulator-reservoir device, that is, one using pressure from the high pressure side of the circulating system to activate the pressure piston.

In a third illustrated embodiment of the invention, remote signaling means is used to indicate or to signal fluid quantity conditions in the system. The oscillatory lever, or equivalent movable part, is caused to operate control means connected in a signaling system. Underfilled or overfilled or "Empty" or "Full" conditions of the system, or both, may appropriately be signaled.

An object of the invention is to provide a temperature compensated quantity indicator substantially as set forth above.

Other objects and structural details of the invention will appear from the following description, when read in connection with the accompanying drawings, wherein:

FIG. 1 is a diagram of a liquid coolant circulating system, showing indicating apparatus in accordance with a first illustrated form of the invention;

FIG. 2 is a detail view in perspective showing a spring wound reel mechanism associated with the apparatus of FIG. 1;

FIG. 3 is a view similar to FIG. 1, showing a connection and indicating means in accordance with an illustrated embodiment of the invention; and FIG. 4 is a diagram illustrating a third invention embodiment.

Referring to the drawings, the illustrated system circulates liquid coolant for cooling purposes, as for example to cool electronic equipment in aircraft. The system circulates an appropriate liquid coolant through electronic equipment or other heat producing source, here diagrammatically indicated as a "Heat Load" 10. The system will ordinarily include a number of valve and other components but for purposes of illustrating the present invention there has been shown incorporated in the system only a pump 11, a thermostatic actuator accommodating chamber 12, a heat exchanger 13, and a reservoir accumulator device 14. A flow conduit 15 connects heat exchanger 13 to one side of the heat load 10. A flow conduit 16 connects the other side of heat load 10 to the pump 11. A flow conduit 17 leads from pump 11 to thermostat accommodating chamber 12. A flow conduit 18 leads from chamber 12 back to the heat exchanger 13. In the operation of the system, liquid coolant directed through heat load 10 absorbs heat from heat producing means therein. The operation of pump 11 draws the heated fluid from load 10 and directs it by way of flow conduit 17, chamber 12 and flow conduit 18 to heat exchanger 13 and thence by way of flow conduit 15 back to the heat load 10. As will be understood, the heated coolant in flowing through heat exchanger 13 is caused to yield up some of its absorbed heat to another fluid flowing in heat transfer relation to the coolant. While this may variously be accomplished there has for illustrative purposes been shown a fan 19 arranged adjacent the heat exchanger to pull air therethrough in a cross flow relation to the flowing coolant.

The accumulator-reservoir device 14 includes a cylinder having larger and smaller diameter portions 21 and 22 in which move pistons 23 and 24 respectively. A rod 25 rigidly interconnects the pistons 23 and 24. A flow conduit 26 connects cylinder portion 21 to one side of the piston 23 to flow conduit 16. A flow conduit 27 connects cylinder portion 21 to the opposite side of piston 23 to flow conduit 17. The flow circuit is closed and may be regarded as having high pressure and low pressure sides respectively beyond and in advance of pump 11. Accordingly, and in the illustrated instance, the interior of piston portion 21 to the right of piston 23 (as viewed in the drawing) is connected by conduit 27 to the high pressure side of the circuit. The cylinder portion to the left of piston 23 (as viewed in the drawing) is connected by conduit 26 to the low pressure side of the circuit. The cylinderportion 21 to both sides of piston 23 is filled with the liquid coolant. Fluid pressure admitted to the cylinder by way of flow conduit 27 is in part balanced by smaller diameter piston 24 but a sufficient resultant force remains to urge the piston 23 to the left or toward what may be regarded as the closed end of the cylinder. Flow conduit 26 and what may be regarded as the inlet side of pump 11 accordingly is continuously flooded with a pressurized fluid coolant.

Coolant losses from the system are made up by an expulsion of fluid from device 14 by way of flow conduit 26. Similarly, since the piston 23 is effectively balanced between supplied and created fluid pressure it responds to changing fluid density and to changing fluid quantity by axial adjustments within the cylinder.

The thermostat chamber 12 is a part of a unitary means 28 also embodying other structures and other apparatus comprising a mechanism to indicate the quantity of fluid coolant in the circulating system. A shaft 29 (see also FIG. 2) is rotatably mounted in the unitary means 28 and has secured theretor a reel 31 on which is wound a cable 32. One end of the cable 32 is suitably fixed to the reel 31. Another end extends from the reel into what may be regarded as an open end of accumulator-reservoir device 14 where it attaches by means of an eye 33 to the piston assembly therein and more particularly to smaller diameter piston 24. To one side of the reel 31, and also surrounding shaft 29, is a clock type spring 34. At its center, spring 34 attaches to shaft 29. An outer convolution of the spring is suitably anchored in the unitary means 28. As will be understood, rotation of the reel 31 and shaft 29 in one direction serves to stress the spring 34 which thereupon applies a force to return the reel and shaft in an opposite rotary direction. The arrangement accordingly is one to translate longitudinal reciprocable movements of the piston assembly 23–25 into rotary or oscillating movements of the shaft 29. Movement of the piston assembly in a leftward direction, as viewed in FIG. 1, serves to unwind or pay-out the cable 32 from the reel 31, in the process of which the reel turns in a counterclockwise direction. This has the effect of winding or stressing the spring 34. Movement of the piston assembly in an opposite or rightward direction releases the stored energy in spring 34 in a manner to rotate reel 31 in a clockwise direction and take up cable 32.

To the other side of reel 31 is a pinion 35 made fast to the shaft 29. The pinion 35 meshes with a rack 36. At an outer end thereof, rack 36 is pivotally connected to a lower end of a lever 37 an upper end of which is pivotally connected to a rod 38. The latter is a part of a thermal power generating device 39 a portion 41 of which is positioned in chamber 12 to be contacted by fluid coolant circulating under the urging of pump 11. In a manner which it is unnecessary here to consider, the thermal means or power generating unit 39 responds to increasing and lowering fluid temperature by relatively extending and retracting the rod 38. A number of thermal motors or thermostatic devices of the kind here diagrammatically shown are commercially available and are suitable for use herein. Intermediate its ends, the lever 37 is pivotally connected to an outer end of a rack 42. The latter extends into meshing engagement with a pinion 43 on a shaft 44 mounted in the unitary means 28. Also on the shaft 44 is a pointer 45 extending to traverse a scale 46. The scale 46 has a generally arcuate representation of calibrations 47 between full and empty designations at opposite ends of the scale.

In operation of the system, pump 11 is in continuous operation, circulating fluid coolant through and between the heat load 10 and heat exchanger 13. In the device 14, opposite sides of the piston 23 exhibit a pressure differential the effect of which is to urge the piston 23 leftward or toward the closed end of the cylinder and to maintain pressure fluid at the pump inlet. If fluid is lost from the system or if a lowering temperature brings about a higher fluid density, the loss of fluid or seeming loss of fluid must be made up out of fluid in the accumulator-reservoir device which is maintained under pressure by the action of piston 23. The piston 23 and its connected parts 25 and 24, accordingly move leftward as fluid effectively is displaced from the reservoir device to maintain a flooded condition at the pump inlet. This leftward motion unwinds cable 32 from reel 31 and effects a counterclockwise motion (FIG. 1) of pinion 35. Rack 36 accordingly is moved leftward and, if the loss of fluid coolant is actual rather than seeming, rocks lever 37 about its pivot point as represented by its point of attachment to rod 38. This has the effect of pulling rack 42 leftward and rotating pinion 43 in a counterclockwise direction raising pointer 45 along the scale 46 so that it more closely approaches the Empty designation. In a similar manner, if fluid coolant is added to the system, as during an initial charging or recharging operation, or if rising temperatures cause a lowering of fluid density, pressure at the pump inlet rises above that necessary to maintain a flooded condition and as a result back pressure is created in the closed end of the accumulator-reservoir device. This pressure is effective to move the piston 23 rightward until the predetermined pressure difference on opposite sides of the piston are reestablished whereupon the piston stabilizes and in a newly established position continues to apply pressure in the system. The movement of piston 23 to the right is accompanied by a clockwise rotation of the reel 31 under the influence of spring 34. This moves rack 36 to the right and, if the addition of fluid coolant is actual rather than seeming, rocks lever 37 in a counterclockwise direction about its point of attachment to rod 38. This moves rack 42 to the right and turns pinion 43 clockwise to cause pointer 45 to assume a position on scale 46 more nearly approaching the Full designation. The arrangement provides, as will be understood, for a direct reading of plural incremental positions on the scale 46 between Empty and Full.

Movements of the piston 23 which are a function of changing fluid density due to temperature change are accompanied by a corresponding response in thermostat 38 relatively to extend and retract rod 38. Under these conditions, therefore, a rotary increment of movement of the reel 31 to effect a movement of oscillatory lever 37 is accompanied by a corresponding movement of rod 38 to shift the pivot point of the lever. The result is substantially to cancel out or to nullify the effects of the rotary turning movement of reel 31 substantially to preclude movement of rack 42 and of pinion 43 and pointer 45. Thus, even though the piston 23 has shifted its position in the accumulator-reservoir device 14 pointer 45 remains motionless and there is no change in the indicated quantity of fluid in the system. A change in the position of the pointer accordingly becomes a true reflection of changing fluid quantity and the quantity indicated on the scale 46 is always the true quantity of fluid in the system, irrespective of temperature conditions.

The invention may take another form as shown in FIG. 3 where a reel 48 and a cable 49 correspond to reel 31 and cable 32 of the first considered embodiment. The reel 48 is fixed to a shaft 51 and a clock type spring 52, working through the shaft, urges reel 48 in a direction to take up the cable and maintain a following relation to a retracting accumulator-reservoir pressure piston (not shown). Also fixed to the shaft 51 is a gear 53 meshing with an idler pinion 54. The latter is rotatably mounted on one end of a lever 55 pivotally mounted intermediate its ends on the shaft 51. The pinion 54 is also in meshing engagement with a rack 56 which in this instance is an arcuate member having gear teeth on its inner periphery. The rack 56 is guided in any suitable manner for oscillatory motion and mounts a pointer 57 which traverses a scale 58 having Full to Empty calibrations 59. It will be evident that rotation of the shaft 51 is effective through gear 53 and pinion 54 to move the rack 56 and thereby to cause pointer 57 to traverse scale 58.

The introduction of a temperature correction is in this embodiment accomplished by thermal means including a bulb 61 and a bellows 62. The bulb 61 and bellows 62, together with an interconnecting flow conduit 63 are filled with a fluid having a property of expansion under heat. A rod 64 projects from one end of the bellows 62 and has mounted thereon a yoke 65 pivotally attached to what may be regarded as an outer free end of the lever 55. The bulb 61 is inserted in the liquid coolant circulating system, as for example by being installed in a chamber corresponding to chamber 12 of the FIG. 1 embodiment. As a result, temperature changes in the circulating coolant produce a corresponding expansion and contraction of the fluid in the fluid filled thermal means and an extension and contraction of the bellows 62. In response to temperature change of the circulating coolant, therefore, corresponding oscillatory adjustments are made in the position of lever 55.

A clockwise direction of rotation of reel 48 results from a movement of the pressure applying piston in the accumulator-reservoir device occasioned by filling of the system or by expansion of the coolant due to rising temperature. In the former event gear 53 on shaft 51, acting through idler pinion 54 and rack 56 moves pointer 57 toward the Full indication on the scale 58. In the event, however, that motion of the pressure piston is a function of coolant expansion due to temperature rise, rotation of the gear 53 is accompanied by a bodily rocking motion of pinion 54 as the outer free end of lever 55 is lifted due to expansion of bellows 62. Accordingly, while the pinion 54 is rotated as a result of its meshing engagement with gear 53 it is simultaneously moved downward along rack 56, rolling in the teeth thereof. The result is to cancel out or to nullify the effects of rotation by gear 53 so that the motion of both gear 53 and of pinion 54 is accomplished relatively to the rack 56. Pointer 57 accordingly continues to designate on scale 58 a calibration indicative of the true quantity of coolant in the system. A counterclockwise direction of rotation of reel 48, unwinding cable 49 therefrom, occurs when the pressure piston moves in the accumulator-reservoir device responsive to a loss of fluid from the system or a lowering system temperature. A corresponding counterclockwise rotation of the gear 53 thereby is produced and a resultant clockwise direction of rotation of the pinion 54. If the movement of the pressure piston, to which the parts have responded, is the result of loss of coolant from the system then there is no compensating adjustment of thermally responsive bellows 62 and rack 56 is allowed to move, adjusting pointer 57 in a more nearly approaching direction toward Empty on the scale 58. If, however, motion of the pressure piston has resulted from a decreasing coolant temperature, causing an increase in coolant density, then rotation of gear 53 and pinion 54 is compensated for by a bodily rocking motion of lever 55 in a counterclockwise direction. As a consequence, pinion 44 is caused to roll upward in rack 56 negating or canceling the effects of its rotation by gear 53. Pointer 57 accordingly does not move and reflects no change in the indicated coolant quantity.

The invention has been disclosed with respect to particular embodiments. Modification in the invention structure is of course possible and is contemplated. For example, different thermal means have been shown in connection with the different illustrated embodiments. The thermal means of either embodiment may be used in connection with the other, if desired, as will be evident. Also, while the invention has been disclosed in connection with an accumulator-reservoir device of the bootstrap type it will perform equally as well with one in which the pressure piston is subjected to the urging of a compression spring or the like. Reference has been made to filling of the system and it will be understood that the system as diagrammatically shown in FIG. 1 will normally be constructed with means selectively to fill or to charge the system with fresh coolant. This is an operation conducted under pressure with the applied pressure as reflected in the closed end of the accumulator-reservoir device 14 being sufficient to effect a deflecting movement of the pressure piston toward the open end of the cylinder, this motion being allowed to continue until the pointer reaches the Full designation on the indicating scale. At this time the system is fully charged and the applied pressure of fresh coolant is discontinued.

Motion of the movable pointer 45 or 57 can be used to operate switches remotely signaling Full and Empty conditions of the system. Such an invention embodiment is diagrammatically shown in FIG. 4, where an oscillatory part 66, corresponding to pointer 45 or 57, positions between opposing plungers 67 and 68 of separate switch devices 69 and 71. The switches 69 and 71 are appropriately connected in an electrical circuit which further includes light bulbs 72 and 73 in a parallel relation to one another and controlled respectively by switches 69 and 71. Movement of the part 66 in a counterclockwise direction causes it to depress plunger 67, closing switch 69 and illuminating bulb 72. This remotely signals a changed fluid quantity in the system, for example a condition in which the system is underfilled or "Empty." Movement of the part in the opposite or clockwise direction causes it to depress plunger 68, closing switch 71 and illuminating bulb 73. This remotely signals another changed fluid quantity condition, for example one in which the system is "Full". It will be evident that elements of the embodiment may be variously used and arranged to serve desired ends. For example, illumination of bulb 73 may be used to signal an overfill of the system rather than a "Full" condition. In the interest of simplicity, only a single switch and its related bulb might be used to signal a warning that the fluid system is less than fully charged or has failed to remain so. A normally "off" switch 69 and its bulb 72 could serve the purpose. The switches may, of course, be positioned to be actuated by part 66 at any selected point in its movement.

What is claimed is:

1. In a system circulating a fluid coolant;

a. an accumulator-reservoir device communicating with the system and having a pressure applying piston a position of which in the device is effected by changing system quantity and by fluid expansion and contraction due to temperature change, b. means positionable to indicate the quantity of fluid coolant in the system, c. a mechanical connection from said piston to said indicating means translating movement of said piston into adjustment in the position of said indicating means, d. thermal means sensing temperature change in the fluid coolant, and e. means operated from said thermal means introducing a correction in said connection so that movement of said piston resulting from temperature change is not translated into adjustment in the position of said indicating means.

2. A system, according to claim 1, wherein, a. said connection includes an indicating means actuating oscillatory lever, b. said thermal means providing a shiftable pivot point for said lever.

3. A system, according to claim 1, said connection including, a. a cable attached to said piston, b. a spring actuated reel on which said cable is wound, c. means including an oscillatory lever for translating rotary movements of said reel into adjustments in the position of said indicating means, d. means providing a normally stationary pivot point about which said lever oscillates, and e. said pivot point being shiftable by said thermal means.

4. A system, according to claim 3, a. said thermal means having an axially extensible and retractable extension to which an end of said lever is pivotally connected, b. said means for translating rotary movements of said reel including a pinion and rack connection from said reel to an opposite end of said lever, and another rack and pinion connection from an intermediate point of said lever to said indicating means.

5. A system, according to claim 1, a. said thermal means comprising extensible and retractable means, b. said connection including an oscillatory lever, and c. said thermal means being attached to said lever to effect rocking movements thereof in response to extension and retraction of said thermal means.

6. A system according to claim 5, a. said indicating means including rack and pointer means movable to and fro and a scale with respect to which said rack and pointer means moves, b. said connection further including a spring activated reel and cable assembly in a connected relation to said pressure applying piston, a gear driven thereby and an idler pinion between said gear and the rack of said rack and pointer means, c. said idler pinion being relatively rotatably mounted on said lever at one end thereof, d. said thermal means being attached to said lever at its opposite end, and e. said lever being mounted intermediate its ends for relative rocking motion.

7. A system, according to claim 1, a. said system incorporating a pump for circulating the fluid coolant, b. said pump having a high side and a low side having regard to the fluid pressure at a pump outlet and a pump inlet respectively, c. said accumulator-reservoir device including a cylinder having spaced connections to the high and low side of said pump and said piston positioning in said cylinder to utilize the higher pressure at the high side of said pump to urge said piston in one direction in said cylinder to apply fluid pressure to the low side of said pump, d. expansion of the fluid coolant due to temperature increase or increases in quantity due to an adding of fluid coolant serving to displace said piston in the opposite direction while maintaining the application of pressure, e. said mechanical connection from said piston to said indicating means including a cable attached at one end to said piston, a spring reel to which said cable is attached at its other end, and a positive drive from said reel to said indicating means, and f. said positive drive including a part adjustable by said thermal means to make said correction.

8. In a system circulating a fluid coolant;

a. an accumulator-reservoir device communicating with the system and having a pressure applying piston a position of which in the device is affected by changing system quantity and by fluid expansion and contraction due to temperature change, b. a positionable part movable in opposite directions and means utilizing movement of said part in at least one direction to indicate a changed fluid quantity condition in the system, c. a mechanical connection from said piston to said positionable part translating movement of said piston into movement of said part, d. thermal means sensing temperature change in the fluid coolant, and e. means operated from said thermal means introducing a correction in said connection so that movement of said piston resulting from temperature change is not translated into movement of or adjustment in the position of said positionable part.

9. A system according to claim 8, wherein;

a. the means utilizing movement of said part is a relatively remote signaling system.

10. A system according to claim 9, wherein;

a. said remote signaling system includes switch means located to be engaged by said positionable part in the course of its motion in at least one direction.

* * * * *